US010337508B2

(12) United States Patent
Cary et al.

(10) Patent No.: US 10,337,508 B2
(45) Date of Patent: Jul. 2, 2019

(54) FLUID-END OF A HIGH PRESSURE PUMP

(71) Applicant: GARDNER DENVER PETROLEUM PUMPS, LLC, Tulsa, OK (US)

(72) Inventors: Paul Douglas Cary, Broken Arrow, OK (US); Vadim Kachkovskiy, State College, PA (US)

(73) Assignee: GARDNER DENVER PETROLEUM PUMPS, LLC, Tulsa, OK (US)

( * ) Notice: Subject to any disclaimer, the term of this patent is extended or adjusted under 35 U.S.C. 154(b) by 321 days.

(21) Appl. No.: 15/186,093

(22) Filed: Jun. 17, 2016

(65) Prior Publication Data

US 2017/0363082 A1 Dec. 21, 2017

(51) Int. Cl.

| | |
|---|---|
| ***F04B 53/14*** | (2006.01) |
| ***F04B 53/16*** | (2006.01) |
| ***F04B 53/00*** | (2006.01) |
| ***F04B 19/22*** | (2006.01) |
| ***F04B 1/04*** | (2006.01) |
| ***F04B 1/00*** | (2006.01) |
| ***F04B 53/10*** | (2006.01) |
| ***F04B 53/22*** | (2006.01) |

(52) U.S. Cl.

CPC ..... *F04B 53/162* (2013.01); *F04B 1/00* (2013.01); *F04B 1/0404* (2013.01); *F04B 19/22* (2013.01); *F04B 53/007* (2013.01); *F04B 53/10* (2013.01); *F04B 53/14* (2013.01); *F04B 53/16* (2013.01); *F04B 53/22* (2013.01)

(58) Field of Classification Search

CPC .... F04B 53/16; F04B 53/007; F04B 53/1032; F04B 53/10; F04B 53/00; F04B 53/162; F04B 53/14; F04B 53/22; F04B 1/0404; F04B 19/22

See application file for complete search history.

(56) References Cited

U.S. PATENT DOCUMENTS

| | | | | |
|---|---|---|---|---|
| 6,544,012 | B1 | 4/2003 | Blume | |
| 6,910,871 | B1 | 6/2005 | Blume | |
| 7,484,452 | B2 | 2/2009 | Baxter et al. | |
| 7,513,759 | B1 | 4/2009 | Blume | |
| 9,188,121 | B1 * | 11/2015 | Dille | F04B 53/007 |

(Continued)

OTHER PUBLICATIONS

Fig. 1A and Fig. 1B of of U.S. Pat. No. 9,383,015 as described in background are prior art.

*Primary Examiner* — Nathan C Zollinger

(74) *Attorney, Agent, or Firm* — Michael Best & Friedrich LLP

(57) ABSTRACT

A pump including a housing defining a plurality of inlet bores. A first interior wall is arranged to at least partially define a first of the plurality of inlet bores. The first interior wall has a contour in a cross section taken normal to the plunger axes. The first interior wall is at least partially defined by the revolution of the contour about a first inlet axis that is normal to and intersects a first of the plurality of plunger axes. The contour includes a cylindrical portion arranged parallel to the first inlet axis, a planar portion extending in a direction perpendicular to the first inlet axis and spaced a first distance from the plunger axis, and a convex bulge portion extending from the cylindrical portion and spaced a second distance from the plunger axis. The contour further includes a V-shaped groove portion extending from the convex bulge portion.

20 Claims, 7 Drawing Sheets

(56) References Cited

U.S. PATENT DOCUMENTS

| | | | | |
|---|---|---|---|---|
| 2008/0080994 | A1 | 4/2008 | Gambier et al. | |
| 2008/0152523 | A1 | 6/2008 | Jensen et al. | |
| 2014/0086774 | A1* | 3/2014 | Chandrasekaran ... | F04B 53/007<br>417/559 |
| 2015/0361745 | A1* | 12/2015 | Guerra ..... | F04B 1/0421<br>417/437 |

* cited by examiner

FLUID-END OF A HIGH PRESSURE PUMP

FIELD OF THE INVENTION

The present invention relates to reciprocating pumps, and more particularly, to the inlet bore of reciprocating pumps.

BACKGROUND

Well-servicing pumps are often used in high fluidic pressure applications to service a pre-drilled oil well. Conventional well-servicing pumps typically include a power-end for driving the pump and a fluid-end for allowing reciprocation of pistons and fluid. The fluid-end includes at least one suction bore, at least one plunger bore, at least one discharge bore, and at least one valve cover bore that all converge at a common intersection or crossbore. The intersection can experience fluidic pressure in excess of 15,000 psi.

SUMMARY

In one embodiment, the invention provides a pump including a housing defining a plurality of plunger bores, a plurality of inlet bores, and a plurality of discharge bores. The pump further includes a plurality of plungers each disposed within one of the plunger bores and reciprocal along one of a plurality of plunger axes. A first interior wall is arranged to at least partially define a first of the plurality of inlet bores. The first interior wall has a contour in a cross section taken normal to the plunger axes. The first interior wall is at least partially defined by the revolution of the contour about a first inlet axis that is normal to and intersects a first of the plurality of plunger axes. The contour includes a cylindrical portion arranged parallel to the first inlet axis, a planar portion extending in a direction perpendicular to the first inlet axis and spaced a first distance from the plunger axis, and a convex bulge portion extending from the cylindrical portion and spaced a second distance from the plunger axis. The second distance is less than the first distance. The contour further includes a V-shaped groove portion extending from the convex bulge portion.

In another embodiment, the invention provides a pump including a housing defining an inlet bore and a plunger bore. The pump further includes a plunger disposed within the plunger bore and reciprocal along a plunger axis. A first interior wall is arranged to at least partially define the inlet bore. The first interior wall has a contour in a cross section taken normal to the plunger axis. The first interior wall is at least partially defined by the revolution of the contour about a first inlet axis that is normal to and intersects the plunger axis. The contour includes a cylindrical portion arranged parallel to the first inlet axis, a planar portion extending in a direction perpendicular to the first inlet axis and spaced a first distance from the plunger axis, and a convex bulge portion extending from the cylindrical portion and spaced a second distance from the plunger axis. The second distance is less than the first distance. The contour further includes a V-shaped groove portion extending from the convex bulge portion.

In yet another embodiment, the invention provides a pump including a housing, a cross-bore intersection formed in the housing, and a plunger bore formed in the housing. The plunger bore has a plunger axis and is in communication with the cross-bore intersection via a plunger port. The pump further includes a plunger received within the plunger bore. The plunger reciprocates within the plunger bore along the plunger axis. The pump further includes a discharge bore formed in the housing. The discharge bore has a discharge axis and is in communication with the cross-bore intersection via a discharge port. The pump further includes a valve cover bore formed in the housing. The valve cover bore has a valve cover axis and is in communication with the cross-bore intersection via a valve cover port. The pump further includes an inlet bore formed in the housing. The inlet bore has an inlet axis and is in communication with the cross-bore intersection via an inlet port. The pump further includes a plunger bore transition area at the plunger port. The plunger bore transition area is adjacent the cross-bore intersection. The pump further includes a valve cover bore transition area at the valve cover port. The valve cover bore transition area is adjacent the cross-bore intersection. The pump further includes a V-shaped groove portion traversing a curvilinear path between the plunger bore transition area and the valve cover bore transition area. The V-shaped groove portion is adjacent the cross-bore intersection and extends about the inlet axis. An interior wall is defined by the inlet bore. The interior wall is adjacent the V-shaped groove portion. The interior wall has a convex bulge portion that converges radially inward, relative to the inlet axis, gradually from the V-shaped groove portion. The interior wall has a concave portion that converges radially outward, relative to the inlet axis, gradually from the convex portion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
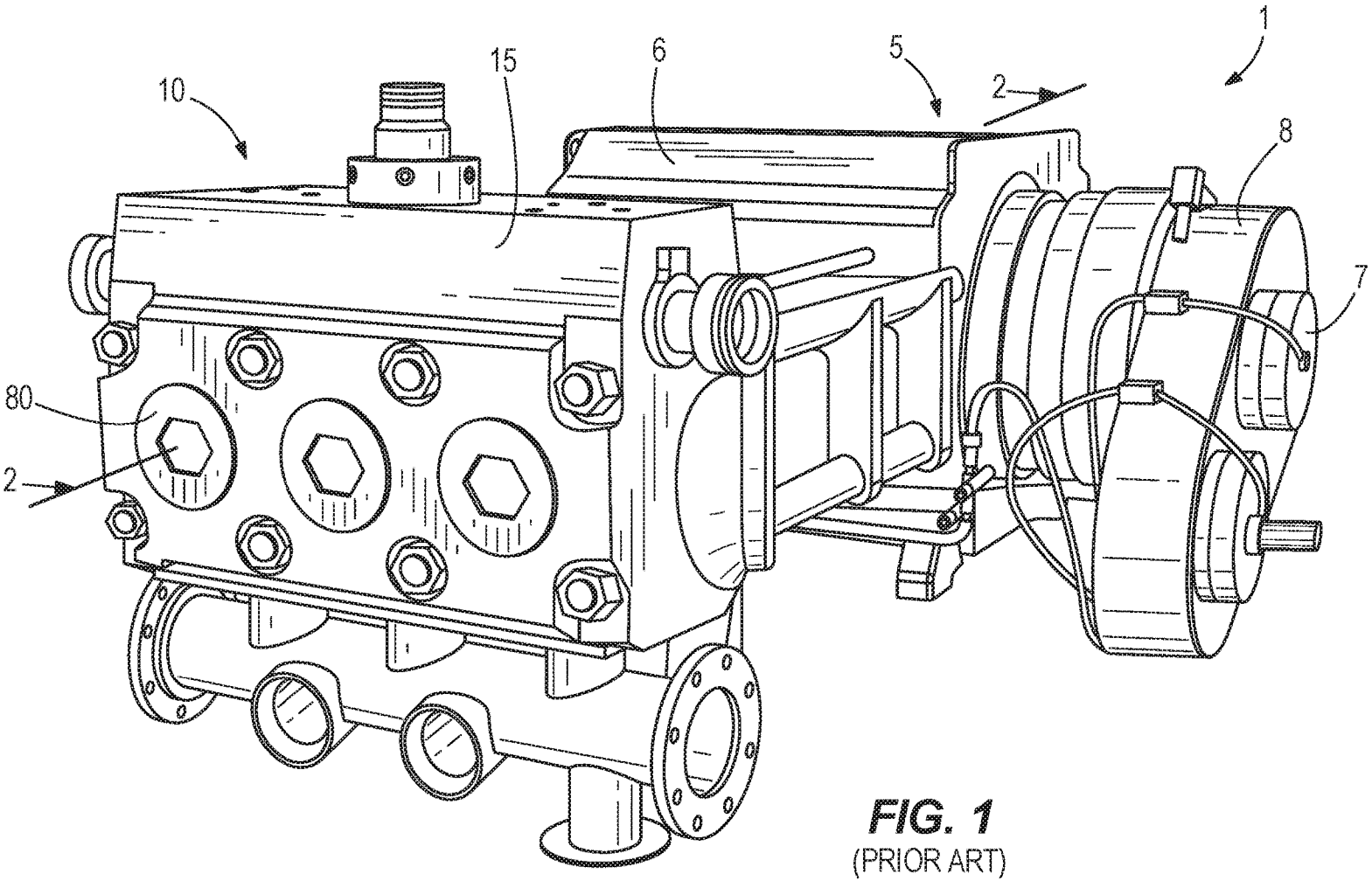
FIG. 1 (PRIOR ART)
FIG. 1 is a perspective view of a pump in accordance with an embodiment of the invention, illustrating a fluid-end and a drive-end.
Figure 2:
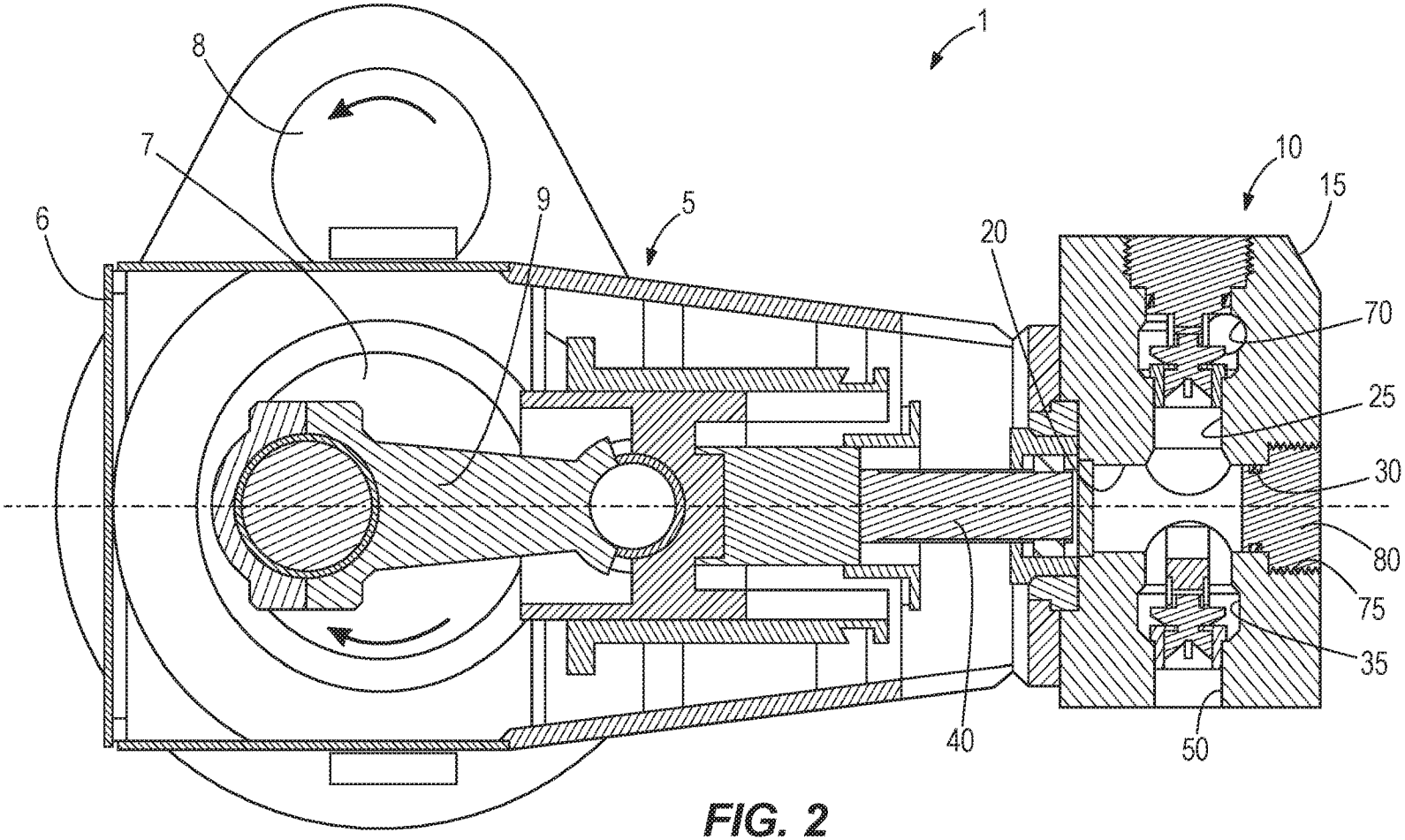
FIG. 2 (PRIOR ART)
FIG. 2 is a cross-sectional view alone line 2-2 of the pump of FIG. 1.

FIGS. 1 and 2 illustrate a pump 1 including a drive-end 5 and a fluid-end 10. The drive-end 5 includes a housing 6, a crankshaft 7 rotatably supported with the housing 6, and a gear train 8 to drive the crankshaft 7 via a motor. The drive-end 5 further includes a connecting rod 9 eccentrically mounted to the crankshaft 7. The fluid-end 10 includes a housing 15 that couples to the housing 6 of the drive-end 5.

Figure 3:
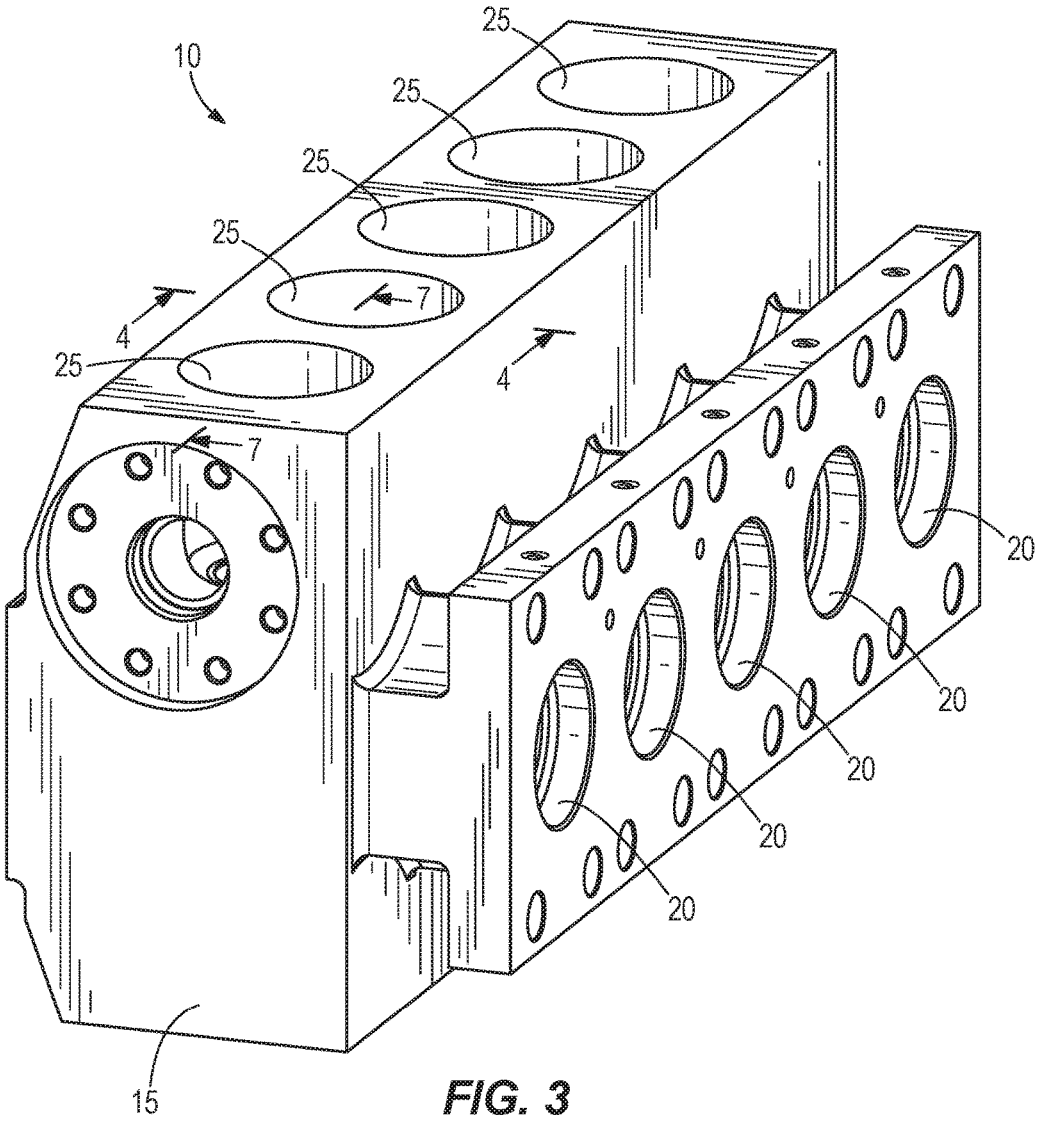
FIG. 3 is a rear perspective view of a housing for the fluid-end.
Figure 4:
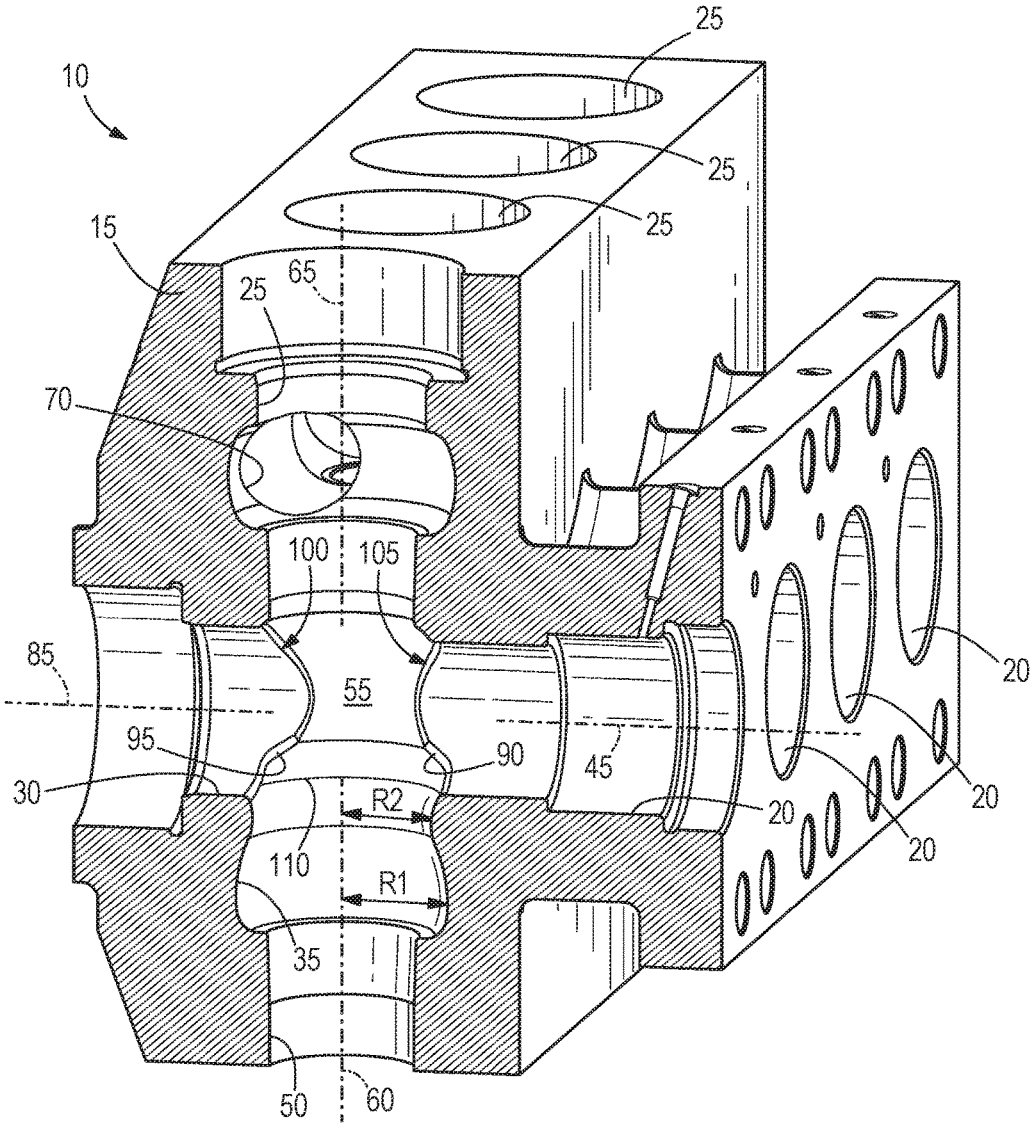
FIG. 4 is a perspective cross-sectional view along line 4-4 of FIG. 3, illustrating an inlet bore, a plunger bore, a discharge bore, and a valve cover bore.

With reference to FIGS. 3 and 4, formed within the housing 15 is a plurality of plunger bores 20, a plurality of discharge bores 25, a plurality of valve cover bores 30, and a plurality of inlet bores 35. The fluid-end 10 also includes plungers 40 that are disposed within each one of the plunger bores 20 (FIG. 2). The plungers 40 may also be referred to as pistons or other reciprocating members in other embodiments. The plunger bores 20 each define a plunger axis 45. Each inlet bore 35 defines inlet axes 60 and are in communication with a fluid inlet 50. The inlet axes 60 are perpendicular and intersect the plunger axes 45. The respective bores 20, 25, 30, 35 converge to a common intersection, referred to as cross-bore intersections 55. Each discharge bore 25 defines discharge axes 65 and are in communication with a fluid outlet 70. The discharge axes 65 are coaxial with the inlet axes 60.

The fluid-end 10 of the illustrated embodiment is formed as a monolithic component via single casting, forging, or other suitable process. In other embodiments, the fluid-end 10 may be formed as multiple pieces via machining, casting, and forging processes. Each of the plunger bores 20, discharge bores 25, valve cover bores 30, inlet bores 35, and cross-bore intersections 55 are substantially identical and therefore only one plunger bore 20, discharge bore 25, valve cover bore 30, inlet bore 35, and cross-bore intersection 55 will be subsequently described for sake of convenience and brevity.

With reference to FIGS. 1 and 2, the valve cover bore 30 includes a threaded region 75 to threadably engage a cover 80. The cover 80 is therefore removably coupled to the valve cover bore 30 along a valve cover axis 85. In other embodiments, the cover 80 may be removably connected to the valve cover bore 30 through other fastening means. When the cover 80 is removed from the valve cover bore 30, an operator can access and maintenance components disposed within the housing 15 of the fluid-end 10.

Figure 5:
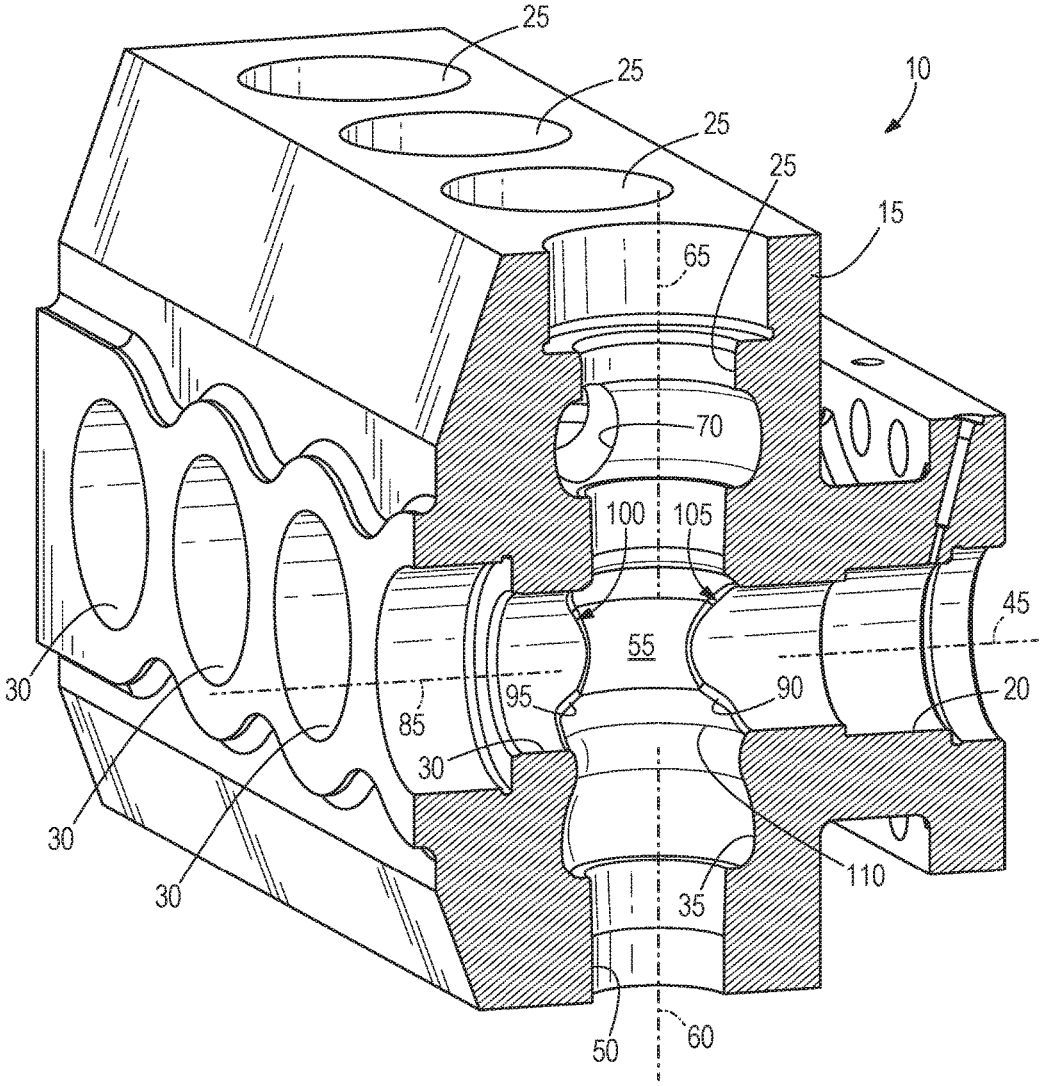
FIG. 5 is another perspective cross-sectional view along line 4-4 of FIG. 3.

With continued reference to FIGS. 4 and 5, the plunger bore 20 interfaces with the cross-bore intersection 55 via a plunger port 90. Similarly, the valve cover bore 30 interfaces with the cross-bore intersection 55 via a valve cover port 95. The plunger port 90 and the valve cover port 95 each define a transition area 100, 105 that smooths potential sharp corners between the bores 20, 30 and the cross-bore intersection 55. As a result of the transition areas 100, 105, stresses at the cross-bore intersection 55 are decreased.

Similarly, a V-shaped groove 110 of the inlet bore 35 is disposed adjacent the cross-bore intersection 55 and also decreases stress at the cross-bore intersection 55. The V-shaped groove 110 traverses along a curvilinear path between the plunger transition area 100 and the valve cover transition area 105. Also, the V-shaped groove 110 extends around the inlet axis 60.

Figure 6:
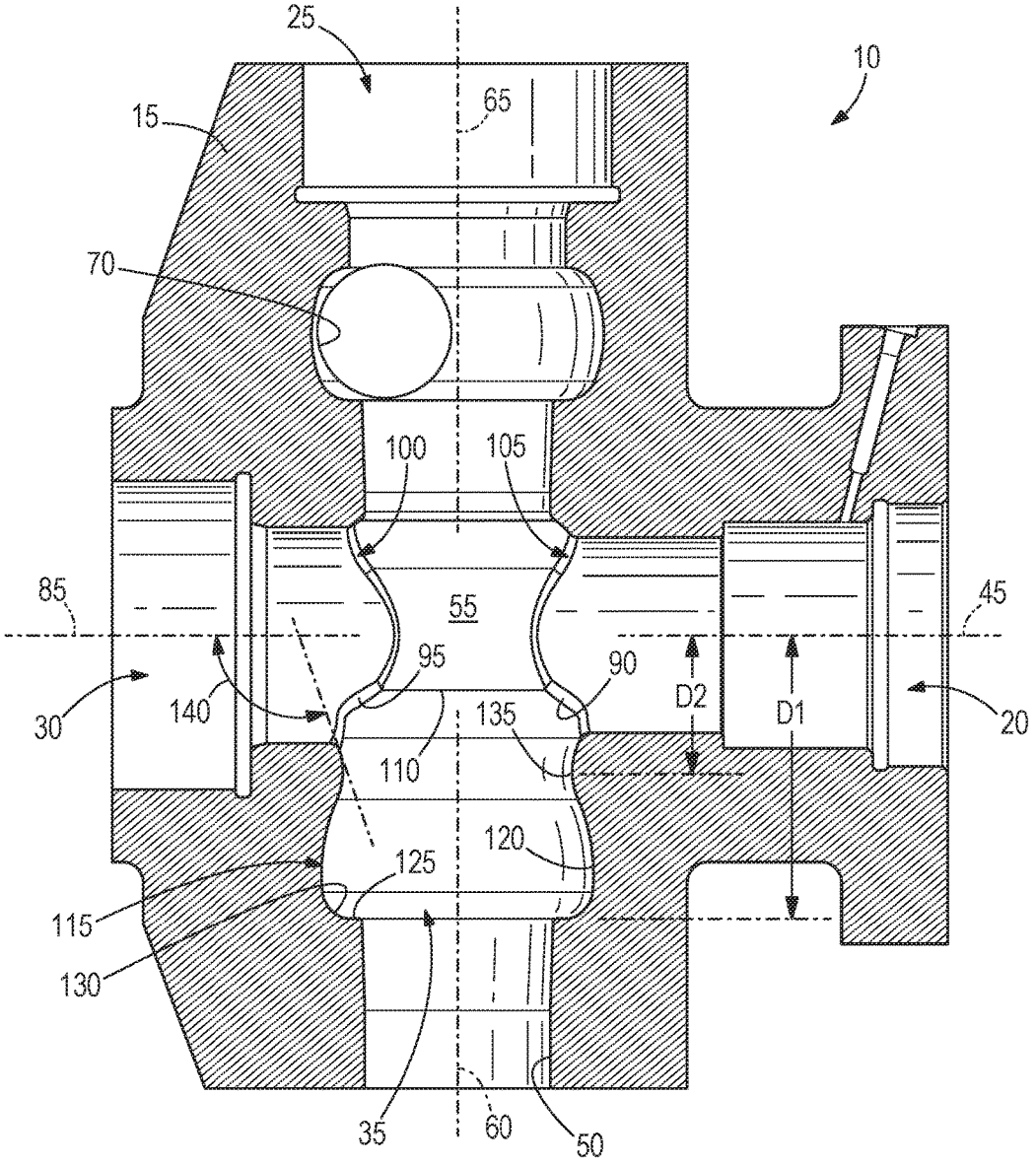
FIG. 6 is a plan cross-sectional view along line 4-4 of FIG. 3.
Figure 7:
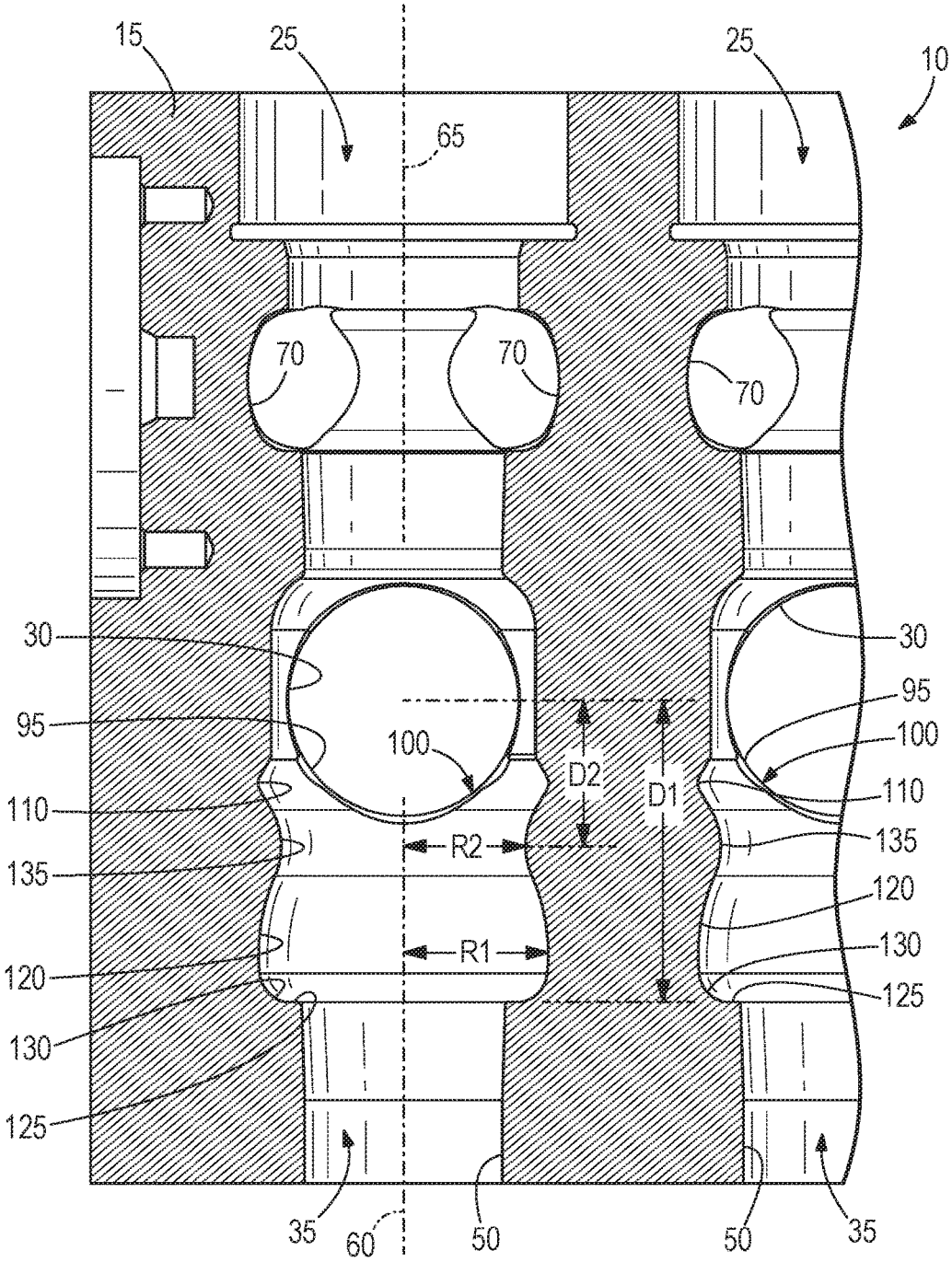
FIG. 7 is a plan cross-sectional view along line 7-7 of FIG. 3.

With reference to FIG. 6, the inlet bore 35 is further defined by an interior wall 115. The interior wall 115 has a contour when viewed in a cross section taken along line 4-4 of FIG. 3. The contour is revolved around the inlet axis 60, such that the contour is substantially identical when viewed in a cross section taken normal to the plunger axis 45 (FIG. 7). As shown in FIG. 6, the contour includes a concave or cylindrical portion 120 that is arranged parallel to the inlet axis 60.

With continued reference to FIG. 6, the contour of the interior wall 115 further includes a planar portion 125 that extends in a direction normal to the inlet axis 60. The planar portion 125 is adjacent the fluid inlet 50 and is spaced a first distance D1 away from the plunger axis 45. A fillet portion 130 of the interior wall 115 interconnects the cylindrical portion 120 and the planar portion 125, such that the cylindrical and planar portions 120, 125 tangentially converge to form a concavity.

The interior wall of the illustrated embodiment further includes a convex bulge portion 135 extending from the cylindrical portion 120. Particularly, the convex bulge portion 135 is interposed between the cylindrical portion 120 and the V-shaped groove 110. The convex bulge portion 135 tangentially converges with the V-shaped groove 110 and the cylindrical portion 120. The convex bulge portion 135 is spaced a second distance D2 relative to the plunger axis 45 that is less than the first distance D1. Essentially, the convex bulge portion 135 extends radially inward from the V-shaped groove 110 and the cylindrical portion 120.

With reference to FIG. 6, the interior wall 115 creates a stress reducing taper angle 140. The taper angle 140 is defined between the valve cover axis 85 and the surface where the V-shaped groove 110 and the convex bulge portion 135 tangentially converge. The taper angle 140 is an obtuse angle such that the taper angle 140 is above 90 degrees. The taper angle 140 is generally greater than 90 degrees and less than 150 degrees. More specifically, the taper angle 140 is 120 degrees.

In one specific embodiment of the invention, at an outermost radial extent of the V-shaped groove 110 relative to the inlet axis 60, the V-shaped groove 110 is spaced between 70 mm to 99 mm away from the inlet axis 60. Specifically, the V-shaped groove 100 is spaced 73.4 mm away from the inlet axis 60 at the outermost radial extent of the V-shaped groove 110. Furthermore, at an outermost radial extent (i.e., radial distance R1) of the cylindrical portion 120 relative to the inlet axis 60, the cylindrical portion 120 is spaced between 76 mm to 101 mm away from the inlet axis 60. Specifically, the radial distance R1 of the cylindrical portion 120 is spaced 83.75 mm away from the inlet axis 60 (FIG. 4). Also, at an innermost radial extent (i.e., radial distance R2) of the convex bulge portion 135 relative to the inlet axis 60, the convex bulge portion 135 is spaced between 60 mm to 98 mm away from the inlet axis 60. Specifically, the radial distance R2 of the convex bulge portion 135 is spaced 70.6 mm away from the inlet axis 60 (FIG. 4).

In operation, each plunger 40 reciprocates along the plunger axis 45 of each plunger bore 20. As each plunger 40 reciprocates along the plunger axes 45, away from the valve cover bore 30, fluid is drawn into each inlet bore 35 through the fluid inlet 50. Subsequently, the fluid passes into cross-bore intersections 55 along the inlet axes 60. At this point, each plunger 40 reciprocates along the plunger axes 45, toward the valve cover bore 30, which causes the fluid to exit the fluid-end 10 of the pump through each discharge bore 25 along the discharge axes 65. Specifically, the fluid exits through the fluid outlet 70 disposed within the discharge bore 25. Each plunger continuously reciprocates along the plunger axes 45 to draw fluid into the fluid-end 10 and to eject the fluid from the fluid-end 10.

Thus, the invention provides, among other things, an interior wall 115 of an inlet bore 35 having a geometry to reduce stresses on a fluid-end 10 of a pump caused by fluidic pressures. The invention minimizes operating stresses in the lower quadrant (or hemisphere) of the cross-bore intersection 55. The invention improves the fatigue life of the fluid-end 10 of the pump. The taper angle 140 tends to reduce the stress concentration at the cross-bore intersection 55 by blending the geometry of the inlet bore 35 and better distributing the load around the cross-bore intersection 55. Various features and advantages of the invention are set forth in the following claims.

The invention claimed is:

1. A pump comprising:

a housing defining a plurality of plunger bores, a plurality of inlet bores, and a plurality of discharge bores;

a plurality of plungers each disposed within one of the plunger bores and reciprocal along one of a plurality of plunger axes; and a first interior wall arranged to at least partially define a first of the plurality of inlet bores, the first interior wall having a contour in a cross section taken normal to the plunger axes, the first interior wall at least partially defined by the revolution of the contour about a first inlet axis that is normal to and intersects a first of the plurality of plunger axes, the contour including:

a cylindrical portion arranged parallel to the first inlet axis;

a planar portion extending in a direction perpendicular to the inlet axis and spaced a first distance from the plunger axis;

a convex bulge portion extending radially inward toward the inlet axis relative to the cylindrical portion and spaced a second distance from the plunger axis, the second distance being less than the first distance; and a V-shaped groove portion extending from the convex bulge portion.

2. The pump of claim 1, further comprising a fillet portion interconnecting the cylindrical portion and the planar portion.

3. The pump of claim 2, wherein the V-shaped groove portion and the convex bulge portion intersect at a tangent.

4. The pump of claim 3, wherein the convex bulge portion, the planar portion, the fillet, and the cylindrical portion each intersect one another at tangents.

5. The pump of claim 1, wherein the convex bulge portion extends radially inward, relative to the inlet axis, from the V-shaped groove and the cylindrical portion, the convex bulge portion is spaced a first radial distance from the inlet axis.

6. The pump of claim 5, wherein the first radial distance is between 60 mm and 98 mm.

7. The pump of claim 5, wherein the first radial distance is 70.6 mm.

8. The pump of claim 5, wherein the cylindrical portion is spaced a second radial distance from the inlet axis, the second radial distance being greater than the first radial distance.

9. The pump of claim 8, wherein the second radial distance is between 76 mm and 101 mm.

10. The pump of claim 8, wherein the second radial distance is 83.75 mm.

11. A pump comprising:

a housing defining an inlet bore and a plunger bore; and a plunger is disposed within the plunger bore and reciprocal along a plunger axis;

a first interior wall arranged to at least partially define the inlet bore, the first interior wall having a contour in a cross section taken normal to the plunger axis, the first interior wall at least partially defined by the revolution of the contour about a first inlet axis that is normal to and intersects the plunger axis, the contour including:

a cylindrical portion arranged parallel to the inlet axis;

a planar portion extending in a direction perpendicular to the inlet axis and spaced a first distance from the plunger axis;

a convex bulge portion extending radially inward toward the inlet axis relative to the cylindrical portion and spaced a second distance from the plunger axis, the second distance being less than the first distance; and a V-shaped groove portion extending from the convex bulge portion.

12. The pump of claim 11, further comprising a fillet portion interconnecting the cylindrical portion and the planar portion.

13. The pump of claim 12, wherein the V-shaped groove portion and the convex bulge portion intersect at a tangent.

14. The pump of claim 13, wherein the convex bulge portion, the planar portion, the fillet, and the cylindrical portion each intersect one another at tangents.

15. The pump of claim 11, wherein the convex bulge portion extends radially inward, relative to the inlet axis, from the V-shaped groove and the cylindrical portion, the convex bulge portion is spaced a first radial distance from the inlet axis.

16. The pump of claim 15, wherein the first radial distance is between 60 mm and 98 mm.

17. The pump of claim 15, wherein the first radial distance is 70.6 mm.

18. The pump of claim 15, wherein the cylindrical portion is spaced a second radial distance from the inlet axis, the second radial distance being greater than the first radial distance.

19. The pump of claim 18, wherein the second radial distance is 83.75 mm.

20. A pump comprising:

a housing;

a cross-bore intersection formed in the housing;

a plunger bore formed in the housing, the plunger bore has a plunger axis and is in communication with the cross-bore intersection via a plunger port;

a plunger received within the plunger bore, the plunger reciprocates within the plunger bore along the plunger axis;

a discharge bore formed in the housing, the discharge bore has a discharge axis and is in communication with the cross-bore intersection via a discharge port;

a valve cover bore formed in the housing, the valve cover bore has a valve cover axis and is in communication with the cross-bore intersection via a valve cover port;

an inlet bore formed in the housing, the inlet bore has an inlet axis and is in communication with the cross-bore intersection via an inlet port;

a plunger bore transition area at the plunger port, the plunger bore transition area is adjacent the cross-bore intersection;

a valve cover bore transition area at the valve cover port, the valve cover bore transition area is adjacent the cross-bore intersection;

a V-shaped groove portion traversing a curvilinear path between the plunger bore transition area and the valve cover bore transition area, the V-shaped groove portion is adjacent the cross-bore intersection and extends about the inlet axis; and an interior wall defined by the inlet bore, the interior wall is adjacent the V-shaped groove portion, wherein the interior wall has a convex bulge portion that converges radially inward, relative to the inlet axis, gradually from the V-shaped groove portion, and wherein the interior wall has a concave portion that converges radially outward, relative to the inlet axis, gradually from the convex bulge portion.

* * * * *